United States Patent [19]

Lindsey

[11] Patent Number: 4,999,866

[45] Date of Patent: Mar. 19, 1991

[54] TOWEL GUARD

[76] Inventor: Lynn M. Lindsey, 1445 Clairmont Rd., Decatur, Ga. 30033

[21] Appl. No.: 435,725

[22] Filed: Nov. 13, 1989

[51] Int. Cl.[5] ..... A47G 9/06

[52] U.S. Cl. ..... 5/417; 5/427

[58] Field of Search ..... 5/417, 425, 427, 512, 5/513, 418, 419, 420, 424

[56] References Cited

U.S. PATENT DOCUMENTS

| | | | |
|---|---|---|---|
| 1,624,797 | 4/1927 | Morehouse | 5/417 |
| 3,619,824 | 11/1971 | Doyle | 5/424 |
| 3,951,453 | 4/1976 | Zapf | 5/441 |
| 4,137,584 | 2/1979 | Scharber | 5/417 |
| 4,151,618 | 5/1979 | Carpenter | 5/419 X |
| 4,709,430 | 12/1987 | Nicoll | 5/417 |
| 4,726,084 | 2/1988 | Keserovich et al. | 5/417 |
| 4,754,509 | 7/1988 | Pollard | 5/425 |
| 4,788,726 | 12/1988 | Rafalko | 5/425 X |
| 4,800,600 | 1/1989 | Baum | 5/424 X |

FOREIGN PATENT DOCUMENTS

| | | | |
|---|---|---|---|
| 868320 | 5/1961 | United Kingdom | 5/427 |

*Primary Examiner*—Gary L. Smith
*Assistant Examiner*—Michael J. Milano
*Attorney, Agent, or Firm*—James B. Middleton

[57] ABSTRACT

A towel guard is used in conjunction with a beach towel to exclude sand and other debris from the surface of the beach towel. The towel guard is long enough to extend around the perimeter of the towel, and has a cross-sectional shape that provides enough height to exclude the debris. The towel guard may be permanently attached to the towel, or releasably held to the towel. As a releasable attachment, the hook member of hook and loop fasteners is used, the hook member being fixed to the towel guard and engageable with the nap on the surface of the towel.

5 Claims, 1 Drawing Sheet

Fig_1
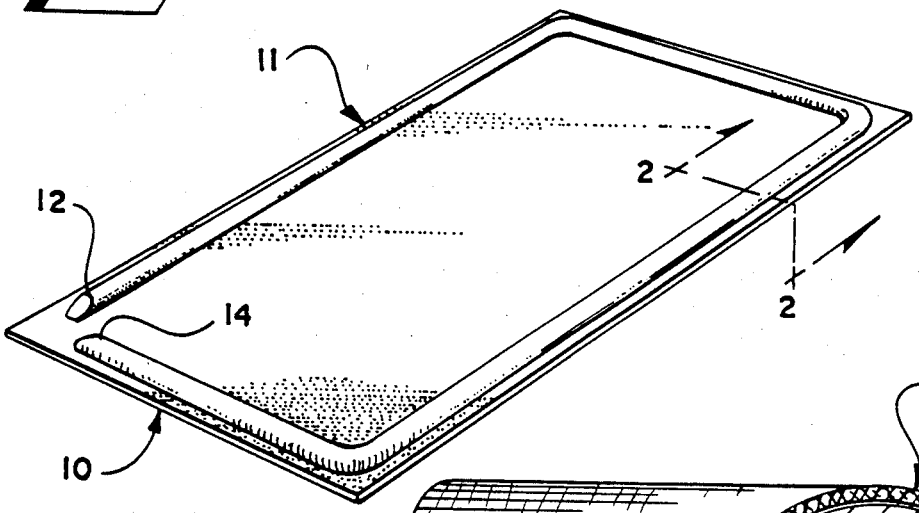
Fig_2
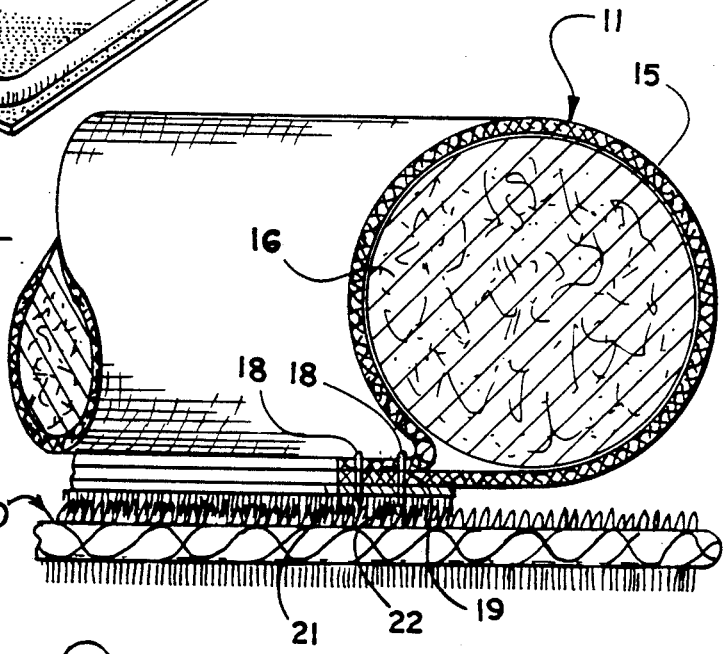
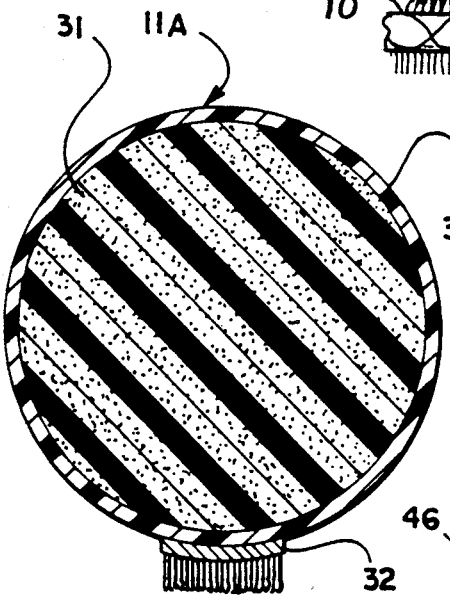
Fig_3
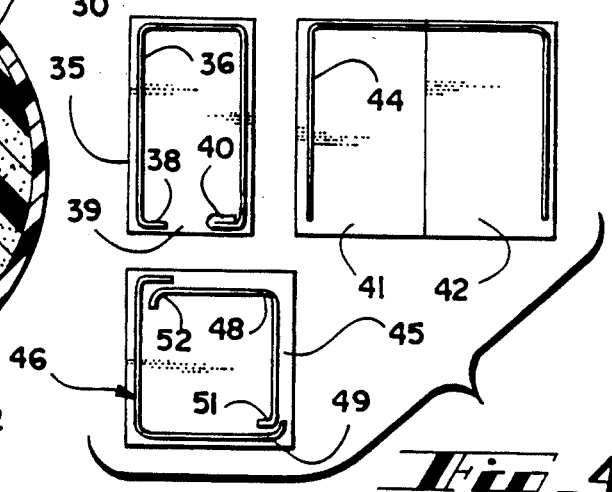
Fig_4

TOWEL GUARD

INFORMATION DISCLOSURE STATEMENT

There are numerous variations of, and accessories for, the conventional beach towel. The prior art includes pockets in towels for storage of items needed at the beach, arrangements to fix a beach towel to a beach chair, and means for weighting down or anchoring a beach towel to prevent inadvertent displacement of the towel. A constant problem with beach towels, however, and one not addressed by the prior art, is the encroachment of sand from the beach onto the beach towel.

One of the major purposes of a beach towel is to allow a person to lie on a sandy beach without direct engagement with the sand. When using a conventional beach towel, however, one might simply step on the edge of the towel and cause the edge to be beneath the sand. Sand then very readily moves onto the towel. Additionally, sand is easily kicked or blown onto a beach towel even though the edges are lying on the surface of the sand.

Thus, a remaining problem with beach towels is that sand and other debris easily and frequently encroach on the towel, defeating a primary purpose for the towel.

SUMMARY OF THE INVENTION

This invention relates generally to beach accessories, and is more particularly concerned with a towel guard for preventing the encroachment of debris onto a towel.

The present invention provides a towel guard to be used in conjunction with a beach towel or the like, the towel guard comprising upstanding wall means on a towel to shield the towel from sand and other debris that may be inadvertently directed towards the towel. The wall means may be permanently fixed to a towel, but is preferably releasably fixable to the towel, and preferably has sufficient height to shield the towel from sand inadvertently kicked or blown towards the towel. For maximum use of the towel, the wall means is substantially at the perimeter of the towel, but may be placed more inwardly if desired.

In the preferred embodiment of the invention, the towel guard includes an elongated, flexible sleeve having filling means, and a strip of hook means for releasably engaging the nap of the towel.

BRIEF DESCRIPTION OF THE DRAWINGS

These and other features and advantages of the present invention will become apparent from consideration of the following specification when taken in conjunction with the accompanying drawings in which:

FIG. 1 is a perspective view of a beach towel having a towel guard made in accordance with the present invention fixed thereto;

FIG. 2 is an enlarged, cross-sectional view taken along the line 2—2 in FIG. 1;

FIG. 3 is a cross-sectional view similar to FIG. 2 showing a modified form of the invention; and, FIG. 4 is a schematic illustration showing various methods of use of the device of the present invention.

DETAILED DESCRIPTION OF THE EMBODIMENT

Referring now more particularly to the drawings, and to those embodiments of the invention here presented by way of illustration, FIG. 1 shows a generally conventional beach towel 10 having a towel guard 11 fixed thereto generally at the edge of the towel. It will be observed that the towel guard 11 substantially surrounds the perimeter of the towel 10 so that a wall surrounds the towel 10. As shown in FIG. 1, the ends 12 and 14 of the guard 11 do not quite meet. This is primarily to illustrate clearly that the guard 11 may be of a discrete length. It will be obvious that, with a towel guard 11 of a given length, the guard may fully encircle one towel, and extend around only a part of a larger towel. The matter of the length of the towel guard 11 will be further discussed hereinafter.

Attention is directed to FIG. 2 of the drawings for a better understanding of the construction of the towel guard of the present invention. In FIG. 2 it will be seen that the towel guard 11 includes a sleeve 15 that is substantially circular in cross-section, the sleeve 15 being shown as filled with a material 16 to hold the sleeve in its extended form. The material 16 is shown in FIG. 2 as a fibrous material; and, those skilled in the art will understand that numerous fibrous materials will be quite satisfactory.

In one successful embodiment of the invention, the material 16 is a roving. Such a material has sufficient density for relatively easy handling, and remains very soft and yieldable. Of course, the specific fiber for the roving is relatively unimportant, though synthetic fibers such as nylon and polyester have the advantages of not being subject to deterioration and not easily holding water. Nevertheless, many other fibers may be quite satisfactory, and various blends of fibers can be used as well.

A roving or other integral material can be used as the material 16, and the roving can be covered with the sleeve 15. It is also possible that loose, or bulk, material can be used, and the sleeve 16 can simply be stuffed. With this technique, the fibrous material can be packed into the sleeve 15 to achieve the desired density. Again, synthetic fibers such as nylon and polyester may be used to advantage, but cotton, wool and other fibers are equally possible choices. Since the device ought to be easily portable, it should be kept in mind that the material 16 should not be extremely heavy. Reasonably light in weight and flexibility are desired characteristics.

The sleeve 15 may also be formed in several ways, the object being simply to contain the material !6 and to provide a surface finish. In the embodiment shown in FIG. 2, the sleeve 15 is fabricated from sheet material such as a woven fabric. Fabrication is quite easy in that the fabric can be stitched together at its edges, as shown at 18, thereby providing the sleeve 15 and an attachment flange 19. Releasable attaching means is then conveniently carried by the flange 19.

Those skilled in the art may devise many attaching means for the towel guard of the present invention, but it has been found that the hook member of the well known hook and loop fasteners (such as "Velcro") is admirably adapted for use as the releasable attaching means. Thus, a strip of the hook member 21 can be attached to the flange 19 by the stitches 18 that secure the edges of the sheet material. The flange 19 attaches easily to the nap 22 of the towel 10. It should be noted that the hook member 21 attaches with great tenacity to the usual terry cloth surface of towels due to the presence of the loops that form the terry. It has also been found, however, that the hook member 21 attaches sufficiently to some cut pile fabrics. The hold will not be as tenacious, but it will be sufficient to hold the towel guard 11 in place on certain fabrics.

With the above description in mind, it will be understood that one can use an ordinary towel with the towel guard of the present invention. Though the above description relates to a beach towel, the only functional difference is in the size of the towel, so a small person may use a small towel, while a large person will prefer a large towel. Any towel having a sufficient nap, or pile surface, to engage the hook member 21 will work quite well with the device shown in FIG. 2, and different attaching means may be used with a towel having no nap. The device may of course be permanently attached to a towel, and the usual stitching may be used, or adhesives and other known permanent attaching means.

Looking again at FIG. 2 of the drawings it will be noted that the flange 19 is sufficiently attached to the nap 22 of the towel 10 that the towel guard 11 will remain in place. The height of the guard then provides the wall to exclude sand and other debris from the towel. Since the attaching means 21 is releasable from the towel 10, it is contemplated that the towel guard will be coiled or folded for transportation and storage. When the towel 10 is laid out on the beach, the guard can be placed generally around the towel as desired.

Attention is next directed to FIG. 3 of the drawings which shows a modified form of the towel guard of the present invention. FIG. 3 shows a towel guard designated at 11A including a sleeve 30 containing a filling material 31. The filling material 31 and the sleeve 30 are indicated as plastic material, the filling material 31 further being indicated as foamed plastic material. It will be readily understood by those skilled in the art that the sleeve 30 may be an extruded tube though of course the sleeve 30 may also be formed from flat, sheet material. The material 31 could easily take the form of foamed polyurethane or the like subsequently covered by the sleeve 30; however, if a polyurethane is desired for the towel guard 11A, it is possible that the polyurethane could be foamed within the sleeve 30. Furthermore, a self skinning foam might be used so the sleeve 30 would be effectively the skin on the foamed material 31. With such a technique, it will be understood that the attaching means 32 might utilize the plastic material itself as the adhesive for holding the attaching means 32 to the sleeve 30. Further, the sleeve 30 may be used without the filling 31 if the sleeve has sufficient integrity to stand up without the filling.

Utilizing the more conventional fabrication technique for the guard 11A, it will be understood that the attaching means 32 can be readily fixed to a plastic sleeve 30 by adhesives or sonic welding and other known techniques. With respect to the filling material 31, or the sleeve without the filling 31, it must simply be kept in mind that the towel guard 11 must be sufficiently bendable to conform to corners of a towel as illustrated in FIG. 1 of the drawings, and the filling material 31, or the sleeve 30 alone, must have sufficient integrity to provide the desired height for the wall means. It will be obvious that the sleeve 30 can be other than circular in cross-section, and any stable polygonal shape will work well.

Looking now at FIG. 4 of the drawings for a further discussion of the use of the towel guard of the present invention, FIG. 4 illustrates a towel 35 that has generally conventional beach towel proportions. The towel guard 36 is indicated schematically, and it will be seen that the guard begins at one of the short sides of the towel at 38 and extends to the corner and along the length of the towel, then traverses the full width of the towel, and the full length again. The towel guard 36 then turns inwardly sufficiently to leave a small gap 39, and the end 40 of the towel guard is folded back to be out of the way. Such an arrangement might be used to allow a person to lie on the towel 35 to have his or her legs extending through the gap 39. With such an arrangement it will be seen that the towel 35 is guarded against intrusion of sand on three full sides, and somewhat on the fourth side.

The next illustration in FIG. 4 shows two towels laid contiguously, the towels being designated at 41 and 42. The towel guard 44 extends the length of the towel 41, then extends the width of the two towels 41 and 42, and finally extends the length of the towel 42. Such an arrangement allows a full end to be open while the towels are guarded on three sides against the intrusion of sand and the like.

Finally, a towel 45 is illustrated, the towel 45 being substantially square. To circumscribe a large square towel, one might utilize two of the towel guards as indicated at 46 and 48. As here shown, the towel guard 46 extends from its end 49, around two full sides of the towel 45 to terminate at 50. The towel guard 48 overlaps the end 49 indicated at 51, traverses two full sides of the towel 45, and overlaps the end 51 of the guard 46 as indicated at 52. Thus, the towel 45 is completely circumscribed by the towel guards 46 and 48 even though the towel 45 is substantially larger than the conventional towel.

It will therefore be understood by those skilled in the art that the towel guard of the present invention might be made in virtually any length, or may be endless, and more than one towel guard can be utilized when required. Nevertheless, it is preferred that the towel guard be long enough to extend around at least three sides of a conventional beach towel. Such a towel guard is quite versatile in that it is usable by most people without modification, and two or more of the towel guards can be used for exceptional situations. If the towel guard is used on an especially small towel, the guard can be folded over as indicated at 40 in FIG. 4 of the drawings.

From the above description, those skilled in the art will determine the desired dimensions of a towel guard, and will of course recognize that the dimensions are highly variable depending on the intended use. Nevertheless, by way of example it has been found that a towel guard having a length of about 5 ½ yards, or 5 meters, is a good length for the average beach towel. With a circular cross-section, a diameter of around 1 to 3 inches, or about 2 ½ to 7 ½ cm, works quite well.

It will therefore be understood by those skilled in the art that the particular embodiments of the invention here presented are by way of illustration only and are meant to be in no way restrictive; therefore, numerous changes and modifications may be made, and the full use of equivalents resorted to, without departing from the spirit or scope of the invention as outlined in the appended claims.

What is claimed is:

1. A towel guard, in combination with a beach towel having a surface, a nap coextensive with said surface, and a perimeter, said towel guard comprising a linear flexible, elongate member, said elongate member having sufficient length to extend around at least the majority of said perimeter of said beach towel, and means for releasably fixing said elongate member to said surface of said towel generally at said perimeter, said elongate member having sufficient height to substantially exclude debris from said surface of said towel when said beach towel is lying flat and said elongate member is fixed to said surface of said towel, generally around said perimeter thereof, said elongate member including a sleeve of said sufficient length and a filling material received within said sleeve, said sleeve being flexible and said filling material acting to maintain the cross-sectional shape of said elongate member, said filling material consisting of a fibrous material, said sleeve consisting of sheet material wrapped around said fibrous material and fixed together, a flange formed on said sleeve where said sheet material is fixed together, said flange carrying said means for releasably fixing said elongate member to said surface.

2. A towel guard as claimed in claim 1, said fibrous material consisting of a roving.

3. A towel guard, in combination with a beach towel having a surface, a nap coextensive with said surface, and a perimeter, said towel guard comprising a linear flexible, elongate member, said elongate member having sufficient length to extend around at least the majority of said perimeter of said beach towel, and means for releasably fixing said elongate member to said surface of said towel generally at said perimeter, said elongate member having sufficient height to substantially exclude debris from said surface of said towel when said beach towel is lying flat and said elongate member is fixed to said surface of said towel, generally around said perimeter thereof, said elongate member including a sleeve of said sufficient length and a filling material received within said sleeve, said sleeve being flexible and said filling material acting to maintain the cross-sectional shape of said elongate member, said filling material consisting of a foamed plastic material, said sleeve consisting of sheet material wrapped around said foamed plastic material and fixed together, a flange formed on said sleeve where said sheet material is fixed together, said flange carrying said means for releasably fixing said elongate member to said surface.

4. A towel guard as claimed in claim 3, said elongate member having a length to extend around at least three sides of said beach towel.

5. A towel guard as claimed in claim 4, said elongate member having a height from about one inch to about three inches.

* * * * *